US006942161B2

(12) United States Patent
Shimada

(10) Patent No.: US 6,942,161 B2
(45) Date of Patent: Sep. 13, 2005

(54) PAINTING MACHINE FOR USE WITH POWDER PAINT

(75) Inventor: Tetsuya Shimada, Aichi (JP)

(73) Assignee: Asahi Sunac Corporation, Owariasahi (JP)

( * ) Notice: Subject to any disclaimer, the term of this patent is extended or adjusted under 35 U.S.C. 154(b) by 578 days.

(21) Appl. No.: 09/983,979

(22) Filed: Oct. 26, 2001

(65) Prior Publication Data

US 2002/0053605 A1 May 9, 2002

(30) Foreign Application Priority Data

Nov. 7, 2000 (JP) ..... 2000-339365

(51) Int. Cl.[7] ..... A62C 5/02

(52) U.S. Cl. ..... 239/8; 239/303; 239/305; 264/40.2

(58) Field of Search ..... 239/8, 303–305, 239/311, 322, 112, 143, DIG. 14; 264/40.1, 40.2, 40.4, 40.7, 211.23; 425/135, 145, 131.1, 169, 204

(56) References Cited

U.S. PATENT DOCUMENTS 2,100,848 A * 11/1937 Hardgrove ..... 241/35
3,782,632 A 1/1974 Braun et al.
3,878,815 A * 4/1975 Gorius ..... 118/318
3,912,235 A 10/1975 Janssen
4,302,481 A 11/1981 Ribnitz et al.
4,684,488 A 8/1987 Rudolph
4,789,569 A * 12/1988 Douche et al. ..... 427/421
4,815,414 A * 3/1989 Duffy et al. ..... 118/308
5,090,626 A * 2/1992 Platsch ..... 239/654
5,148,943 A 9/1992 Moller
5,340,211 A 8/1994 Pratt
5,913,602 A 6/1999 Steele
6,315,214 B1 * 11/2001 Fingleton et al. ..... 239/8

FOREIGN PATENT DOCUMENTS

JP A 8-206580 8/1996
JP A 9-262537 10/1997

* cited by examiner

*Primary Examiner*—Gene Mancene
*Assistant Examiner*—Thach H. Bui
(74) *Attorney, Agent, or Firm*—Oliff & Berridge, PLC

(57) ABSTRACT

A painting machine includes a powder paint spray gun, a mixer for mixing a plurality of powder paints having different colors, and a control device controlling an amount of each powder paint supplied to the powder paint spray gun so that a mixing ratio of the powder paints is continuously changed.

14 Claims, 4 Drawing Sheets

PAINTING MACHINE FOR USE WITH POWDER PAINT

BACKGROUND OF THE INVENTION

1. Field of the Invention

This invention relates to a painting machine suitable for use with powder paint.

2. Description of the Related Art

In painting, one and the same paint is generally painted over a surface of an object to be painted. However, a demand for design with remarkable personality has recently been increased. In such design, elaborate plans have been devised in the coloring. A gradation painting in which gradation is continuously changed is one of techniques for such design. In the conventional gradation painting, a plurality of colors of liquid paints are prepared, and the paints are applied one by one while a location of each paint is being shifted.

In the above-described gradation painting, a plurality of painting machines are provided according to a plurality of the liquid paints, or a single painting machine is provided and the paints are changed from one to another. In the former method, a plurality of the painting machines disadvantageously increase equipment costs. In the latter, the painting efficiency is low since painting is interrupted during changes of colors. Furthermore, in both methods, after one liquid paint has been applied, the paint needs to be dried until the subsequent liquid paint is applied. As a result, painting cannot continuously executed such that the painting efficiency is low.

Another method of gradation painting has been proposed in which a plurality of liquid paints would be mixed into a liquid paint of a desired color. The mixed liquid paint is applied while a compounding ratio of the paint is changed so that the color of the applied paint is gradually changed. However, when the compounding ratio of the liquid paint is changed for toning, the liquid paint before a change in the compounding ratio is mixed with the liquid paint after a change in the compounding ratio has been changed, whereupon a color obtained by mixing differs from a color of an actually applied paint with high possibility. More specifically, since a liquid paint has a high fluidity, it is difficult to mix liquid paints with a plurality of different colors together and to control the mixture to obtain a desired color.

SUMMARY OF THE INVENTION

Therefore, an object of the present invention is to provide a painting machine which can continuously change an applied color without interruption of painting.

The present invention provides a painting machine comprising a powder paint spray gun, mixing means for mixing a plurality of powder paints having different colors, and a control device controlling an amount of each powder paint supplied to the powder paint spray gun so that a mixing ratio of the powder paints is continuously changed.

A color of mixture of the powder paints sprayed from the powder paint spray gun is changed when the mixing ratio of the powder paints is changed while the powder paints are being sprayed from the powder paint spray gun. Consequently, the color of the paint can continuously be changed without interruption of painting. Furthermore, since a powder paint has a lower fluidity than a liquid paint, there is no possibility of changes in the mixing ratio in the case of the powder paint when the powder paint is supplied to the powder paint spray gun. Consequently, the paint can reliably be toned so as to have a desired color.

In a preferred form, the control device controls the amount of each powder paint supplied to the powder paint spray gun so that a total amount of the powder paint supplied to the mixing means per unit time becomes constant. Consequently, a thickness of a paint film can be maintained at a constant value.

In another preferred form, the mixing means includes a plurality of powder paint tanks storing the powder paints and a hopper to which the powder paints are fed from the powder paint tanks, respectively. In this case, the hopper has an interior divided into a plurality of chambers in which the powder paints are stored so that the powder paints are prevented from being mixed. Consequently, the mixing ratio can be prevented from deviation due to the powder paint adherent to an inner wall of the hopper.

BRIEF DESCRIPTION OF THE DRAWINGS

Other objects, features and advantages of the present invention will become clear upon reviewing the following description of an embodiment, made with reference to the accompanying drawings, in which.

DETAILED DESCRIPTION OF AN EMBODIMENT

Figure 1:
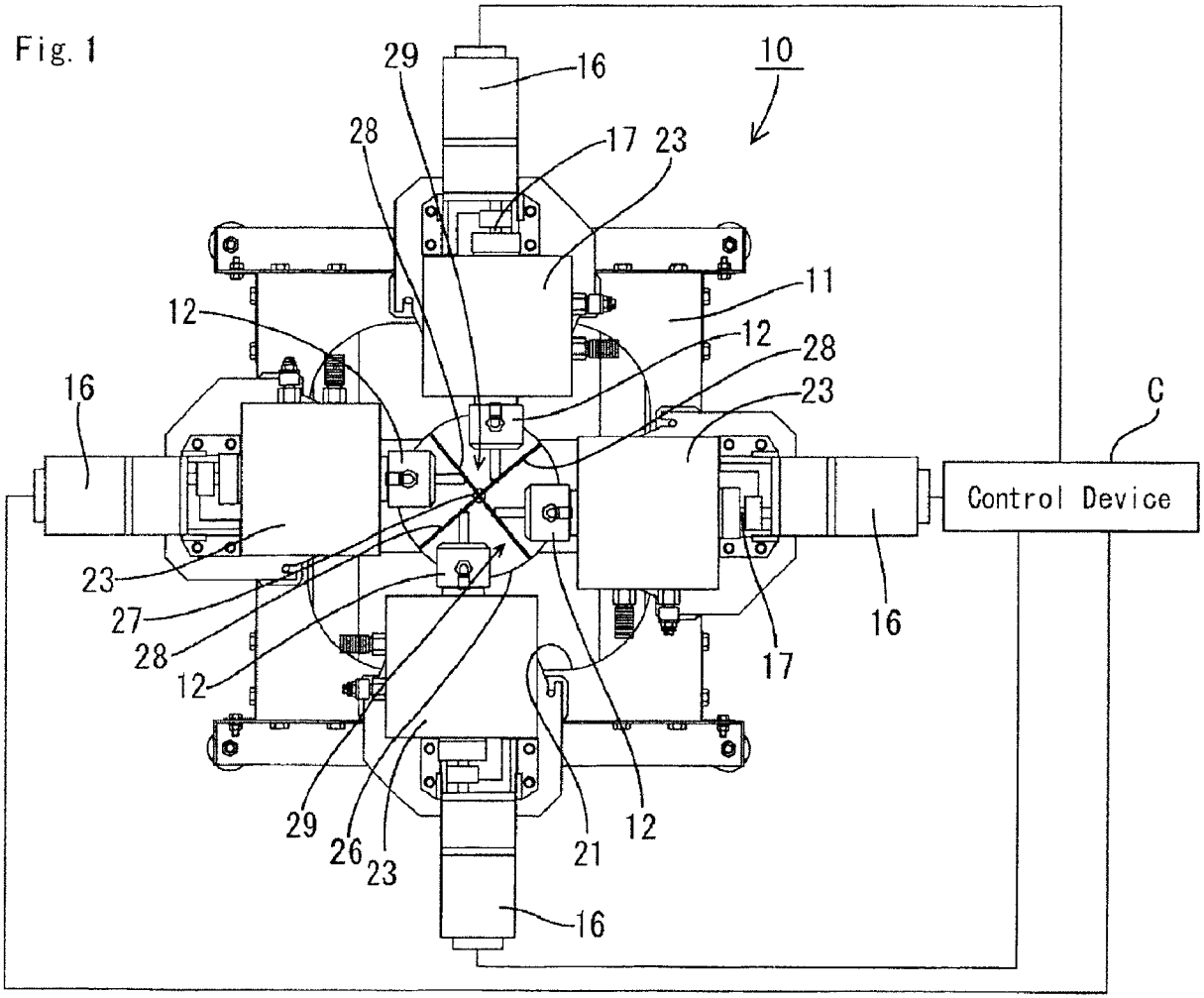
FIG. 1 is a plan view of a painting machine of one embodiment in accordance with the present invention.

One embodiment of the present invention will be described with reference to FIGS. 1 to 4. A painting machine of the embodiment comprises mixing means 10, transferring means 30, a transferring passage 37 and a powder paint spray gun 38. In the embodiment, four powder paints of different colors 1A, 1B, 1C and 1D are mixed at a predetermined mixing ratio so that a mixture of powder paints of a definite color is applied to a surface to be painted.

The mixing means 10 will first be described. The mixing means 10 comprises a base 11 and four screw feeders 12 fixed on an upper face of the base 11 so as to be disposed before and behind and right and left. Each screw feeder 12 includes a cylinder 13 having a horizontal axis and a screw 14 rotatably mounted in the cylinder 13. Each screw feeder 12 further includes a rotational shaft 15 (see FIG. 3) rotated with the screw 14. The shaft 15 has a proximal end connected to an output shaft 17 of an electric motor 16 to be rotated together. The motor 16 serves as a drive source for each screw feeder 12. A control device C controls rotational speeds of the motors 16 individually. Each cylinder 13 has a distal end (opposite to the motor 16) with an exit 18. A lid 19 is mounted on the shaft 15 so as to be axially moved and urged by a return spring (not shown) so as to normally close the exit 18. A pipe-like falling passage 20 extending downward is also connected to each exit 18. The falling passages 20 of the four screw feeders 12 confront a central opening 21 in the upper face of the base 11.

Each screw feeder 12 has a proximal end with an open upper face serving as an acceptor 22. Each of the powder paint tanks 23 is fixed to the acceptor 22 so that an open supply port 24 is connected to the acceptor 22. Four powder paints of different colors 1A, 1B, 1C and 1D are stored in the powder paint tanks 23 respectively. A vibrator 25 is mounted in each of the powder paint tanks 23 so that vibration of the vibrator 25 causes the powder paints 1A, 1B, 1C and 1D to fall smoothly and reliably into the respective screw feeders 12.

Figure 2:
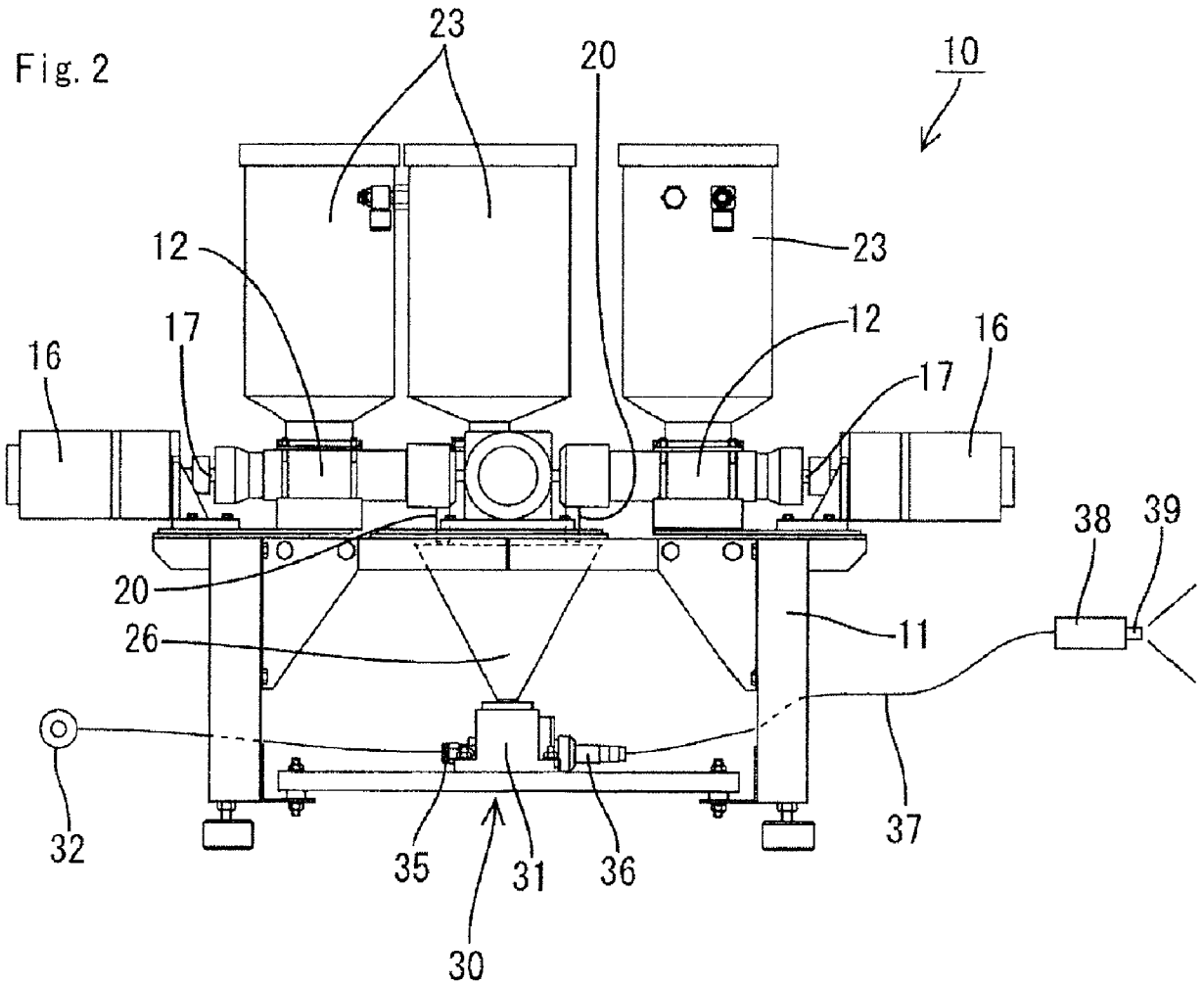
FIG. 2 is a side view of the painting machine.
Figure 3:
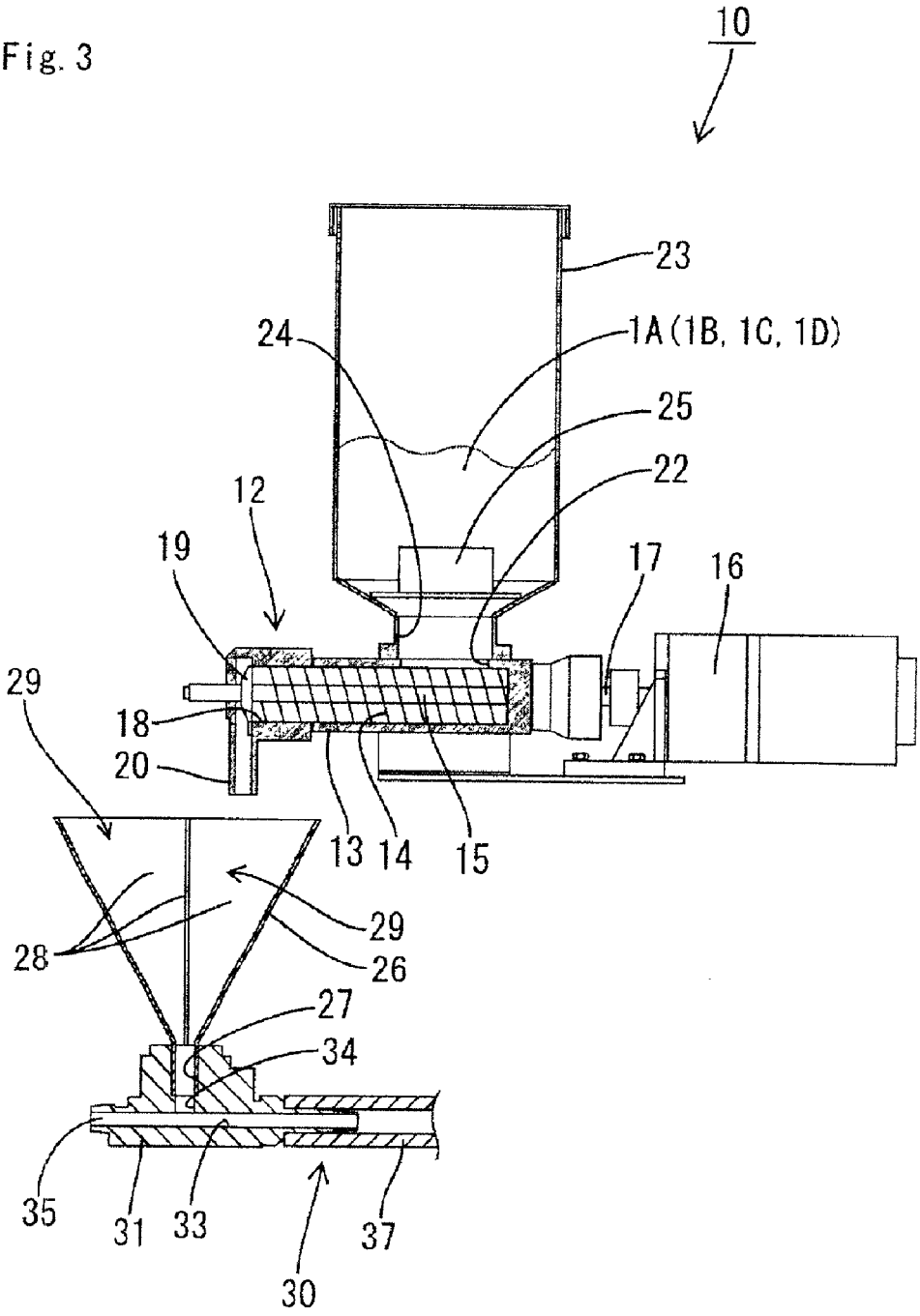
FIG. 3 is a partially cut-out enlarged side view of mixing means employed in the painting machine.

A generally inversely conical hopper 26 is fixed to the base 11 as shown in FIG. 2. The hopper 26 has an open top, and the falling passages 20 of the screw feeders 12 confront the open top of the hopper 20. The hopper 26 has a lower end serving as a supply opening 27. The hopper 26 is fixed at the supply opening 27 to an injector 31 as will be described later. An interior of the hopper 26 is divided by four partition plates 28 so that four circumferentially partitioned supply chambers 29 are defined. The falling passages 20 correspond to the chambers 29 respectively. Since the partition plates 28 extend from the upper end to the lower end of the hopper 26 or to the supply opening 27, the powder paints of different colors can be prevented from being mixed in the hopper 26.

The transferring means 30 will now be described. The transferring means 30 includes an injector 31 and a force feeding source. The injector 31 comprises a flow passage 33 through which air is caused to flow horizontally and a vertical port 34 communicating with the passage 33 and the top of the injector 31. The flow passage 33 has a left-hand end air inlet 35 to which a pressurized air source 32 is connected and a right-hand end air outlet 36 to which a proximal end of the transferring passage 37 is connected. The passage 37 comprises a hose having flexibility. Furthermore, the lower end supply opening 27 of the hopper 26 is connected to the port 34.

The powder paint spray gun 38 is connected to a distal end of the passage 37. The powder paint spray gun 38 is mounted on an automatic machine (not shown) such as a reciprocator or a painting robot so as to be moved according to a previously set program. The powder paint spray gun 38 is connected to a high-voltage power supply so that the mixed powder paints 1A to 1D supplied to the powder paint spray gun 38 are electrically charged by a charging mechanism incorporated in the powder paint spray gun 38. From a nozzle 39 at the distal end of the powder paint spray gun 38 moving, the mixed powder paints 1A to 1D transferred through the passage 37 with the pressurized air flies to an object conveyed along a predetermined path, adhering to the surface by an electrostatic force. The object is electrically conductive and accordingly grounded. A mixture of the powder paints 1A to 1D applied to the surface to be painted is melted at a baking step such that a paint film is formed.

The operation of the powder painting machine will now be described. When the mixture of the powder paints 1A to 1D is to be transferred to the powder paint spray gun 38, each motor 16 is driven at a predetermined speed so that the screw 14 of each screw feeder 12 is rotated at a predetermined speed. Each powder paint supplied from the powder paint tank 23 to the proximal end of the screw 12 is then fed forward at a flow rate proportional to the rotational speed of the screw 14. Each powder paint is fed through the falling passage 20 while opening the lid 19 against the urging force, falling into each corresponding supply chamber 29 of the hopper 26. An amount of each powder paint falling into the supply chamber 29 per unit time changes with time according to the program set in the control device C. Changes in an amount of each powder paint supplied with the passage of time will be described in detail later.

Each powder paint fallen in the corresponding supply chamber 29 further falls from the lower end supply opening 27 of the hopper into the flow passage 33 of the injector 31. In the flow passage 33, the four powder paints 1A to 1D are mixed at a predetermined mixing ratio. The four powder paints mixed together in the flow passage 33 are fed into the transfer passage (hose) 37 with pressurized air force fed from the pressurized air source 32 into the flow passage 33, reaching the powder paint spray gun 38. When transferred from the injector 31 to the powder paint spray gun 38, the powder paints are kept up at a predetermined mixing ratio. The mixture of the powder paints is sprayed from the nozzle 39 of the powder paint spray gun 38 against the object to be painted. Since the powder paint spray gun 38 and the object are moved along a predetermined route at a predetermined speed, portions on the object to which the mixed powder paints are applied are also moved.

The control device is programmed according to a color arrangement on a painted surface of the object and gradation in a boundary between different colors so that amounts of the powder paints 1A to 1D supplied from the screw feeders 12 into the hopper 26 per unit time are changed with the passage of time. The program is based on the moving route and speed of the powder paint spray gun 38 and a conveying route and speed of the object. The above-mentioned amounts of the powder paints will be referred to as "supply amounts." The supply amount of each powder paint is proportional to the rotational speed of each motor 16 or the rotational speed of the screw 14 of each screw feeder 12.

Figure 4:
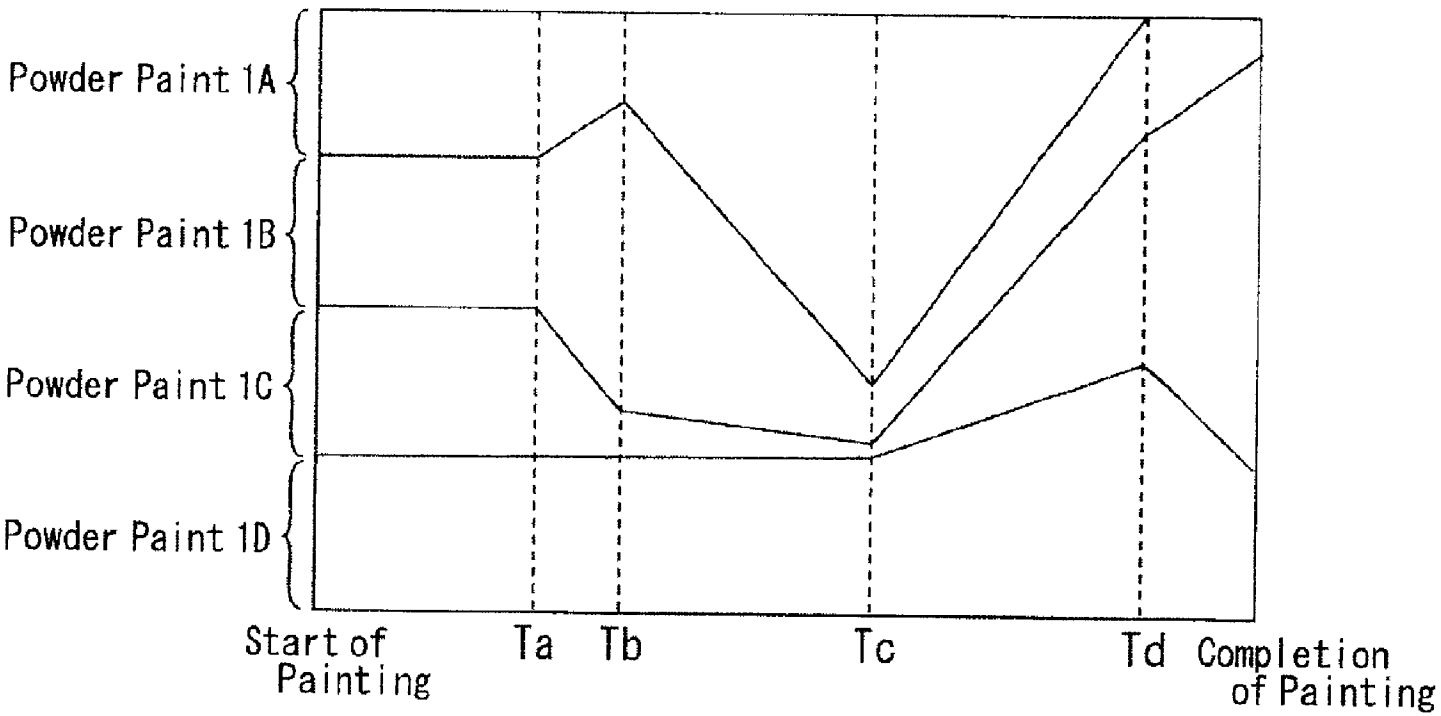
FIG. 4 is a graph showing changes in a mixing ratio of the powder paint with time.

FIG. 4 shows examples of changes in the supply amounts of the respective powder paints 1A to 1D. In the graph, an axis of abscissas denotes time and an axis of ordinates denotes supply amounts of the four powder paints. In a period between start of painting and time Ta, the four powder paints are mixed at such a mixing ratio that amounts of the powder paints become approximately equal to one another, and the mixing ratio is maintained. Accordingly, the color of the mixed paint applied to the surface of the object does not change in this while.

Thereafter, in a period between time Ta and time Tb, the supply amounts of the powder paints 1A and 1C are decreased whereas the amount of the powder paint 1B is increased. The supply amount of the powder paint 1D does not change. With the changes in the supply amounts of the powder paints 1A, 1B and 1C, the color of the mixture of the powder paints applied to the surface of the object is gradually changed such that a gradation pattern is obtained. Furthermore, in a period between time Tb and time Tc, the supply amount of the powder paint 1D is constant. The supply amount of the powder paint 1A is increased whereas the supply amounts of the powder paints 1B and 1C are decreased. As a result, the obtained gradation has a color tone different from one of the gradation in the period between time Ta and time Tb.

Thereafter, in a period between time Tc and time Td, the supply amount of the powder paint 1A is decreased whereas the supply amounts of the powder paints 1B, 1C and 1D are increased. Consequently, the gradation obtained in this period has a color tone different from those of the gradations in the respective periods between time Ta and time Tb and time Tb and time Tc. Furthermore, in a period between time Td and completion of painting, the supply amount of the powder paint 1A is rendered zero or the supply is stopped. The supply amounts of the powder paints 1B and 1D are decreased whereas the supply amount of the powder paint 1C is increased. Consequently, the obtained gradation has a color tone different from those in the periods between time Ta and time Tb, time Tb and time To, and time To and time Td.

In the period between the start of painting and the completion of painting, a total amount of the mixture of powder paints fed by the screw feeders 12 to the powder paint spray gun 38 per unit time is kept constant. Accordingly, an amount of the mixture of the powder paints applied to the surface of the object per unit time and accordingly, a thickness of paint film becomes constant over the surface.

According to the above-described embodiment, the four powder paints of different colors 1A to 1D are continuously supplied to the transferring means 30 while being mixed by the mixing means 10 with the mixing ratio being changed so that the total amount is kept constant. The powder paints are transferred from the transferring means 30 to the powder paint spray gun 38 to be applied to the surface of the object. More specifically, the mixing ratio of the powder paints 1A to 1D is changed while the mixture of powder paints is being sprayed from the powder paint spray gun 38, so that the colors of the mixture sprayed from the powder paint spray gun are changed. Consequently, the color of the mixture of powder paints applied to the surface of the object can continuously be changed without interruption of painting.

Furthermore, since each of the powder paints 1A to 1D has a lower fluidity than a liquid paint, there is no possibility of changes in the mixing ratio in the transferring passage 37 when the powder paints are supplied from the injector 31 of the transferring means 30 to the powder paint spray gun 38. Consequently, the powder paint can reliably be toned so as to have a desired color.

When the four powder paints 1A to 1D are supplied to the injector 31 in the mixed state, the mixing ratio may change before the paints reach the injector. One of the powder paints may adhere to the inner wall of the hopper, for example. Thereafter, when supplied into the hopper, a powder paint of another color is mixed with the powder paint adherent to the inner wall of the hopper when an amount of the powder paint of said another color is large. In such a case, the mixing ratio may possibly shift from the predetermined one. In the foregoing embodiment, however, the interior of the hopper 26 is partitioned into the four chambers 29 so that the four powder paints 1A to 1D are prevented from being mixed together before the powder paints reach the injector 31. Accordingly, even when the powder paint adheres to the inner wall of the hopper 26, another powder paint can be prevented from being mixed with the adherent powder paint. Consequently, the mixing ratio of the powder paints can reliably be kept constant.

It is suggested that the powder paints 1A to 1D in unmixed state should be supplied to the powder paint spray gun 38 with pressurized air so that the powder paints are mixed in the powder paint spray gun. In this case, however, the pressure of the pressurized air sometimes changes accidentally, whereupon the mixing ratio of the powder paints may shift from the initial one. In the foregoing embodiment, the powder paints are mixed at the predetermined mixing ratio in the injector 31, and the mixture of the powder paints is transferred into the powder paint spray gun 38 with pressurized air. Consequently, changes in the mixing ratio can be prevented even if the pressure of the pressurized air changes.

The four powder paints are used in the foregoing embodiment. However, the number of colors of the powder paints may be three or smaller than three, or five or larger than five.

In the foregoing embodiment, the hopper 26 is disposed between the screw feeders 12 and the injector 31, and the interior of the hopper 26 is partitioned into the chambers 29 serving as supply passages through which the respective powder paints are supplied. Hoses or pipes serving as supply passages may be provided between the screw feeders and the injector, instead of the hopper.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. A painting machines comprising:

a powder paint spray gun;

a mixing device to mix a plurality of powder paints having different colors;

a control device controlling an amount of each powder paint supplied to the powder paint spray gun so that a mixing ratio of the powder paints is continuously changed, a desired color of the paint changed by the control device to at least one another desired color through a gradation without interruption of a painting process; and wherein the amount of each powder paint falling into a supply chamber per unit of time changes with time according to a program set in the control device.

2. A painting machine according to claim 1, wherein the control device controls the amount of each powder paint supplied to the powder paint spray gun so that a total amount of the powder paints supplied to the mixing device per unit time becomes constant.

3. A painting machine according to claim 1, wherein the mixing device includes:

a plurality of powder paint tanks storing the powder paints, respectively and a hopper to which the powder paints are fed from the powder paint tanks, the hopper having an interior divided into a plurality of chambers in which the powder paints are stored so that the powder paints are prevented from being mixed in the hopper.

4. A painting machine according to claim 3, further comprising an injector connected to an exit of the hopper to mix the powder paints fed from the hopper, a transferring device connected to the injector for feeding the powder paints mixed by the injector to the powder paint spray gun, and a pressurized air source connected to the transferring means.

5. A painting machine according to claim 3, further comprising a plurality of screw feeders for measuring amounts of the respective powder paints and feeding the measured amounts of the powder paints to the hopper, the screw feeders being disposed radially about the hopper.

6. A painting machine, comprising:

a powder paint spray gun;

a mixing device to mix a plurality of powder paints having different colors; and a control device controlling an amount of each powder paint supplied to the mixing device so that a mixing ratio of the plurality of powder paints can be gradually changed;

wherein a mixture of the plurality of powder paints is supplied to the powder paint spray gun, a desired color of the paint changed by the control device to at least one another desired color through a blending of two or more colors without interruption of a painting process; and wherein the amount of each powder paint falling into a supply chamber per unit of time changes with time according to a program set in the control device.

7. A painting machine according to claim 6, wherein the control device controls the amount of each of the plurality of powder paints supplied to the mixing device so that a total amount of the plurality of powder paints supplied to the mixing means per unit time becomes substantially constant.

8. A painting machine according to claim 6, wherein the mixing device includes;

a plurality of powder paint tanks storing the powder paints respectively, and a hopper to which the powder paints are fed from the powder paint tanks, and wherein the hopper has an interior divided into a plurality of chambers in which the powder paints are fed so that the powder paints are prevented from being mixed in the hopper.

9. A painting machine according to claim 6, further comprising;

an injector connected to an exit of the hopper to mix the plurality of powder paints fed from the hopper, and a transferring device connected to the injector for feeding the plurality of powder paints mixed by the injector to the powder paint spray gun, and a pressurized air source connected to the transferring device.

10. A painting machine according to claim 6, further comprising;

a plurality of screw feeders for measuring amounts of the respective plurality of powder paints and feeding the measured amounts of the plurality of powder paints to the hopper.

11. A painting machine according to claim 6, wherein the control device further comprises the function of controlling the rate of change of the amount of each powder paint based upon the relative location of the object to be painted and the powder paint spray gun.

12. A painting machine according to claim 6, wherein the control device further comprises the function of controlling the rate of change of the amount of each of the plurality of powder paints based upon time.

13. A painting machine according to claim 1, further comprising:

an amount of each powder paint supplied to the powder paint spray gun per unit time changing over time.

14. A method of painting using a powder paint spray gun, comprising:

mixing a plurality of powder paints having different colors;

controlling an amount of each powder paint so that a mixing ratio of the powder paints is continuously changed;

supplying the mixed powder paints to the powder paint spray gun; and changing a color of the mixed powder paint supplied to the powder paint spray gun from a desired color of paint to at least one another desired color through a gradation without interruption of a painting process.

* * * * *